US007753589B2

(12) United States Patent
Palt

(10) Patent No.: US 7,753,589 B2
(45) Date of Patent: Jul. 13, 2010

(54) ENCAPSULATING BAG FOR PRESSURIZED CYLINDERS TO REDUCE PARTICULATE CONTAMINATION FOR CLEAN ROOM USE

(76) Inventor: Neil Palt, 1055 Cinnabar Ct., Santa Maria, CA (US) 93455

( * ) Notice: Subject to any disclaimer, the term of this patent is extended or adjusted under 35 U.S.C. 154(b) by 989 days.

(21) Appl. No.: 11/467,620

(22) Filed: Aug. 28, 2006

(65) Prior Publication Data

US 2008/0050051 A1 Feb. 28, 2008

(51) Int. Cl.

| | |
|---|---|
| ***B65D 33/16*** | (2006.01) |
| ***B65D 30/22*** | (2006.01) |
| ***B65D 33/00*** | (2006.01) |
| ***B65D 33/04*** | (2006.01) |
| ***B65D 30/10*** | (2006.01) |
| ***B65D 85/20*** | (2006.01) |
| ***B65D 65/02*** | (2006.01) |

(52) U.S. Cl. ..... 383/66; 383/40; 383/80; 383/97; 383/105; 383/106; 383/121; 220/446; 150/154

(58) Field of Classification Search ..... 383/66, 383/121, 121.1, 41, 40, 106, 80, 105, 97; 206/446; 150/154

See application file for complete search history.

(56) References Cited

U.S. PATENT DOCUMENTS

| | | | | |
|---|---|---|---|---|
| 1,375,480 | A | | 4/1921 | West |
| 1,460,461 | A | | 7/1923 | West |
| 1,669,061 | A | | 5/1928 | Meltzer |
| 2,078,400 | A | | 4/1937 | Maupin |
| 2,426,475 | A | | 8/1947 | Van Frank |
| 2,838,085 | A | | 6/1958 | Beeler |
| 2,996,213 | A | | 8/1961 | Mitchell et al. |
| 3,578,051 | A | | 5/1971 | Hammon |
| 3,906,129 | A | | 9/1975 | Damois |
| 4,109,692 | A | * | 8/1978 | Brown ..... 220/9.1 |
| D266,056 | S | | 9/1982 | Lear |
| 4,383,528 | A | * | 5/1983 | Eppolito ..... 128/205.22 |
| 4,438,764 | A | * | 3/1984 | Eppolito ..... 128/205.22 |
| D280,438 | S | | 9/1985 | Wendt |
| 4,811,767 | A | | 3/1989 | Kessler |
| 4,844,286 | A | | 7/1989 | Jacobson |
| 4,871,597 | A | * | 10/1989 | Hobson ..... 428/36.1 |
| 5,190,089 | A | | 3/1993 | Jackson |
| 5,356,046 | A | | 10/1994 | Burke |
| 5,423,586 | A | * | 6/1995 | Fuller ..... 294/149 |
| 5,454,492 | A | | 10/1995 | Hunter et al. |
| 5,511,846 | A | * | 4/1996 | Fuller ..... 294/149 |
| 5,555,746 | A | * | 9/1996 | Thompson ..... 62/457.4 |
| 5,677,026 | A | | 10/1997 | Santoli |
| D396,772 | S | | 8/1998 | Hanzok |

(Continued)

*Primary Examiner*—Jes F Pascua
(74) *Attorney, Agent, or Firm*—Felix L. Fischer

(57) ABSTRACT

An encapsulating bag for contamination control on gas cylinders employs a main body of fabric such as polyester or flouropolymer having a weave sufficiently tight to preclude contaminant transmission. A bottom boot engages a lower portion of the main body to cover the bottom of the cylinder. A separation closure means such as a non-metal zipper is incorporated into the main body for opening the main body for insertion of the cylinder. A cuff is attached to a top circumference of the bag main body for close engagement of a top boss of the cylinder to preclude contaminant escape. An ESD button is incorporated in the body of the bag for attachment of a conducting lead for grounding connection.

11 Claims, 3 Drawing Sheets

U.S. PATENT DOCUMENTS

| | | | | |
|---|---|---|---|---|
| 5,915,580 | A * | 6/1999 | Melk | 215/386 |
| 6,012,411 | A | 1/2000 | Hochbrueckner | |
| 6,073,796 | A * | 6/2000 | Mogil | 220/592.17 |
| 6,123,187 | A | 9/2000 | Bartels | |
| D438,425 | S | 3/2001 | Agnew | |
| D457,936 | S | 5/2002 | Garofalo et al. | |
| D460,145 | S | 7/2002 | Johnson | |
| 6,415,946 | B2 * | 7/2002 | Carlo et al. | 220/724 |
| 6,508,282 | B2 | 1/2003 | Garofalo et al. | |
| D473,629 | S | 4/2003 | Johnson | |
| D479,426 | S | 9/2003 | Callahan | |
| D486,551 | S | 2/2004 | McQuiston | |
| D500,117 | S | 12/2004 | Hartmann | |
| D517,162 | S | 3/2006 | Clower | |
| 7,316,435 | B2 * | 1/2008 | Leighton | 294/152 |
| 7,520,549 | B2 * | 4/2009 | Leighton | 294/152 |
| 2004/0020793 | A1 * | 2/2004 | Peterolff et al. | 206/0.6 |

* cited by examiner

ENCAPSULATING BAG FOR PRESSURIZED CYLINDERS TO REDUCE PARTICULATE CONTAMINATION FOR CLEAN ROOM USE

BACKGROUND OF THE INVENTION

1. Field of the Invention

This invention relates generally to the field of clean room processing and, more particularly, to a bag enclosure for containing particulate contamination from gas cylinders during clean room use and general pressure cylinder protection and identification.

2. Description of the Related Art

Gas cylinders are employed in numerous applications. While the applications disclosed herein are directed to clean room usage of such cylinders, other applicable usage can range from home use propane bottles to very high pressure gas applications for welding or other manufacturing and health care uses. The combination of cylinder mass and pressure cycling and release makes the cylinders subject to condensation issues with associated corrosion and contamination as well as chipping or cracking of the paint or other coatings on the cylinders. Particularly where these cylinders are in use in clean room applications, such as in the semiconductor manufacturing industry, contamination caused by particulates shed from these cylinders can be of concern.

It is therefore desirable to provide a system to prevent particulate contamination from gas cylinders. It is further desirable that the system prevent or reduce condensation on gas cylinder surfaces. It is also desirable that the system be easily configured for various gas bottle sizes and be easily installable and removable while being robust in construction for use with multiple cylinders.

SUMMARY OF THE INVENTION

The present invention provides particulate containment for gas cylinders through the use of an encapsulating bag having a main body of fabric such as polyester or flouropolymer having a weave sufficiently tight to preclude cylinder contaminant transmission. A bottom boot engages a lower portion of the main body to cover the bottom of the cylinder. A separation closure means such as a non-metal zipper is incorporated into the main body for opening the main body for insertion of the cylinder. A cuff of clean room approved material is attached to a top circumference of the bag main body for close engagement of a top boss of the cylinder to preclude contaminant escape. An ESD button is incorporated in the body of the bag for attachment of a conducting lead for grounding connection. Color selection for the bag body is employed in alternative embodiments to assist in identification of the cylinder type enclosed within the bag.

The encapsulating bag further includes in certain embodiments a hood having a hood body to be received over a regulator protection safety cap attached to the cylinder for transportation. A hood cuff having a mating taper for the cuff attached to the bag main body is employed on the hood and the hood body is impregnated with carbon fiber. An ESD button and conduction lead are provided for attachment to a second ESD button on the main body of the bag.

Fitted pouches of transparent clean room approved materials attached to the bag body allow display of hazardous material identification placards and material safety data sheets for the contents of the cylinders enclosed in the bag. Use of a fabric enclosure provided by the invention for gas cylinders allows laundering and repetitive use while maintaining a presentable appearance.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

Figure 1:
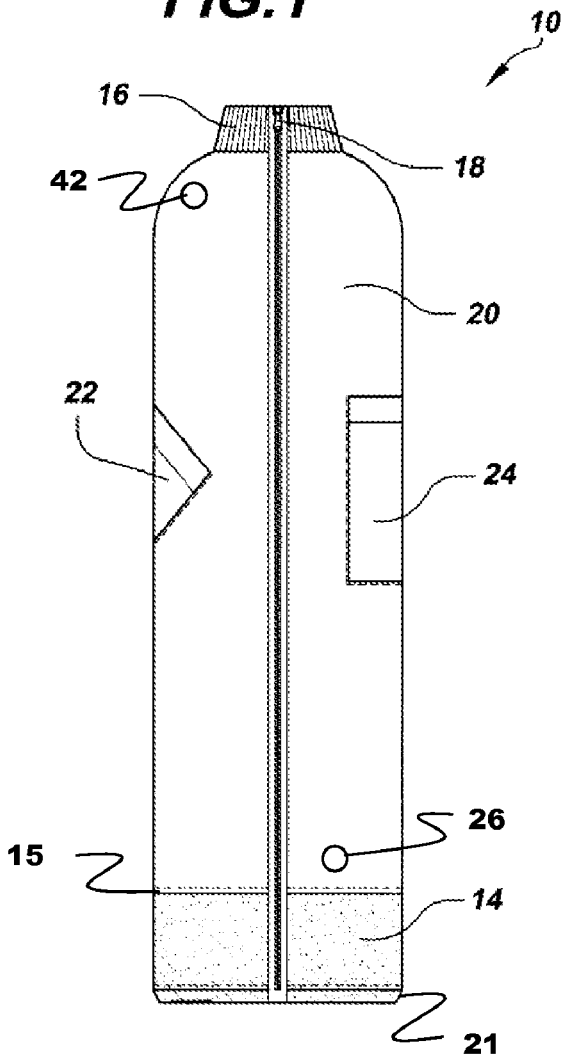
FIG. 1 is a front elevation view of a gas cylinder encapsulated in a particulate contamination encapsulating bag according to the present invention.
Figure 2:
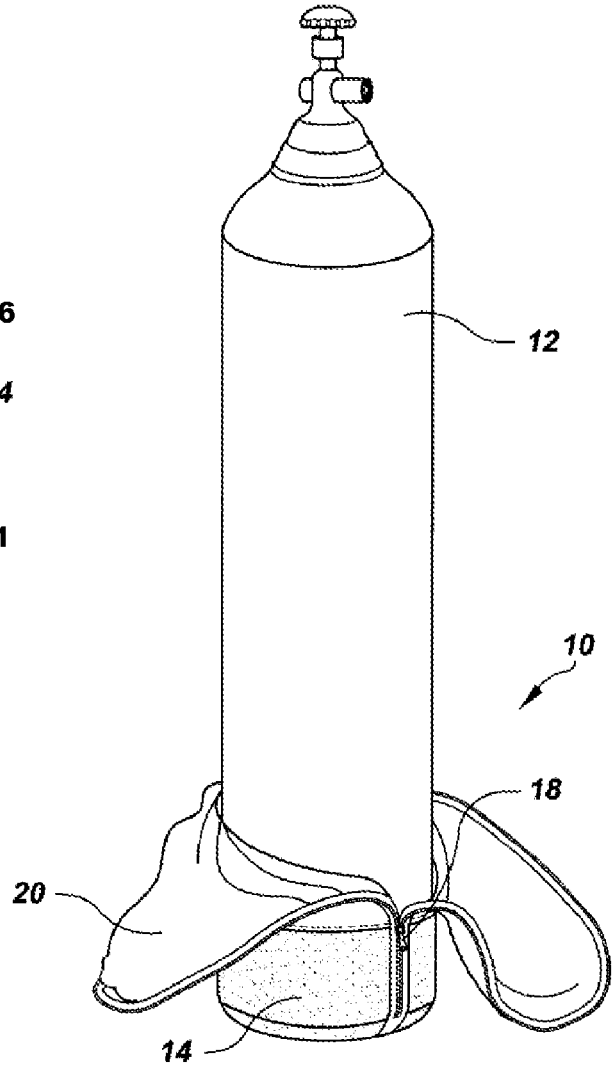
FIG. 2 is a perspective view of the gas cylinder of FIG. 1 with the bag unzipped to demonstrate installation of the bag over an exemplary cylinder.
Figure 3:
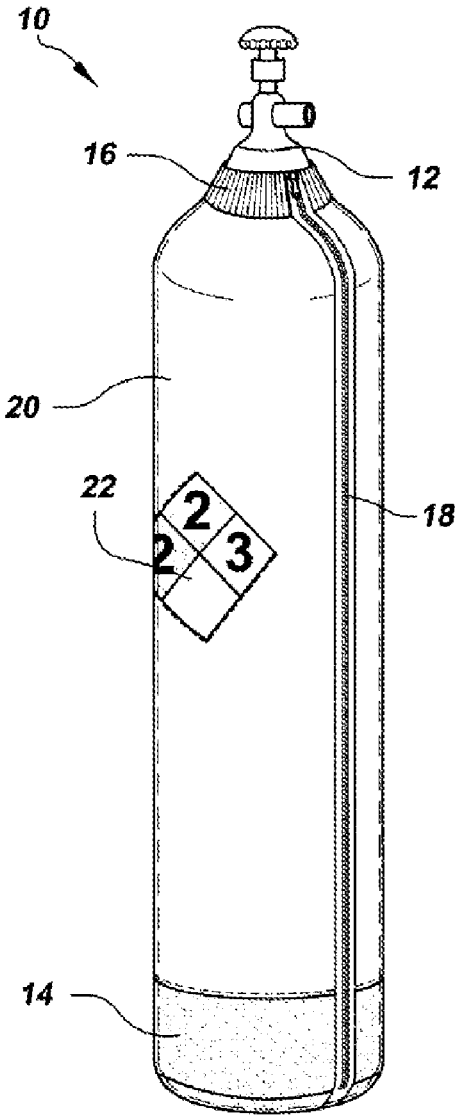
FIG. 3 is a right side perspective view of the bag and gas cylinder of FIG. 1.
Figure 4:
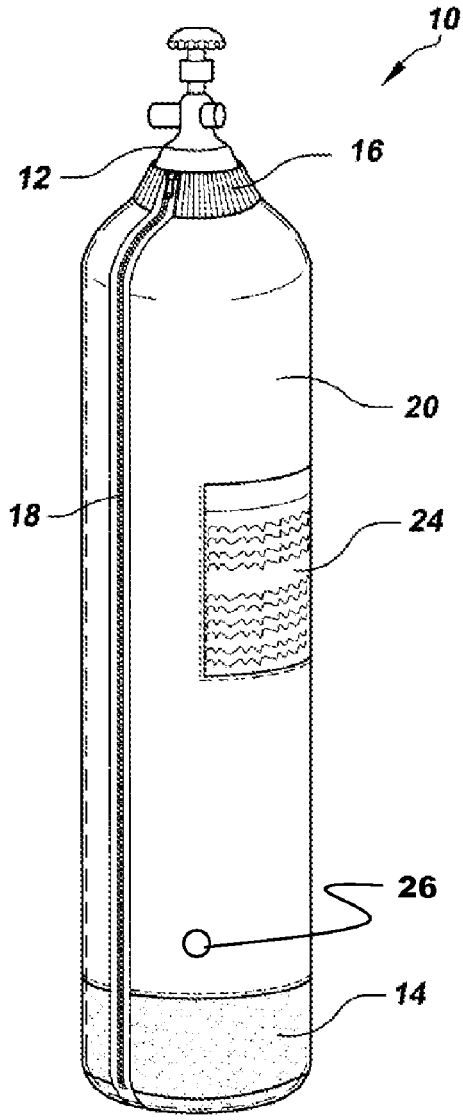
FIG. 4 is a left side perspective view of the bag and gas cylinder of FIG. 1.

The present invention provides a light weight cover in the form of a bag assembly 10 for a gas cylinder 12 such as process gas cylinders employed in a clean room environment for the semiconductor industry. The invention provides protection for the clean room area from particulate contamination from the surface of the cylinder due to chipping or shedding of paint or other coating on the gas cylinder. The bag assembly includes a main body 20 constructed of non-particulating material that breaths to prevent condensation on the encapsulated cylinder. Fabric for the main body is a tight weave preventing egress of particulates through the fabric. Various embodiments of the invention employ Flouropolymer or polyester fabrics having porosities of approximately 4.0 CFM air transmission or less. Polytetraflouroethylene fabric such as Gore-Tex® has been demonstrated in exemplary embodiments of the invention. In certain embodiments, a B-FORE™ polyester material is employed. The main body is impregnated with carbon fibers. The natural conductivity of the fibers in the fabric is employed to enhance conductive properties of the bag for Electro-static Discharge (ESD) grounding. Exemplary surface resistivity of $10^7$-$10^8$ ohms with a static decay of 0.01 sec is provided for the embodiments shown. A ESD contact button 26 secured to the bag assembly allows connection of a grounding lead.

Various color availability for certain embodiments of the invention allow for identification of the cylinder type enclosed in the bag. Conventional coloring consistent with standards for hazard identification may be employed.

A bottom boot 14 is provided as a portion of the bag assembly to increase abrasion resistance and provide increased durability when rolling an encapsulated cylinder as well as addition structural strength to support the cylinder. For the exemplary embodiments shown in the drawings, the boot is fabricated from durable rubber or polystyrene materials. An exemplary boot for the embodiments shown in the drawings employs hypalon adhered to polyester fabric typically employed in booties used for clean room personnel footwear. In various embodiments, the boot is attached to a circumferential opening 21 in the bottom of the main body while in alternative embodiments, the boot receives and encapsulates a contiguous bottom portion of the main body that is contoured to fit the gas cylinder. The embodiment shown in the drawings employs a simple contour for the external circumferential rim 15 of the boot. In alternative embodiments, an embossed ring or pad on the exterior circumference is employed for additional stability for the upright cylinder or to provide a rolling pad for the cylinder to enhance cylinder movement.

A tight cuff 16 of ESD compatible elastic knit cuff material is provided at the upper circumference of the main body of the bag to seal the bag to the neck of the cylinder at the regulator attachment boss. For exemplary embodiments, polyester knit materials comparable to those employed in clean room garment cuffs are employed. The cuff provides flexibility in the neck of the bag assembly to accommodate various neck boss configurations and manipulability to accommodate regulator attachment and protective cover removal while maintaining a seal in its normal configuration to prevent release of contaminants from inside the bag during use with a cylinder.

The main body of the bag incorporates a zipper 18 to allow easy installation and removal of the bag on the gas cylinder. A clean room approved, non-shedding, non-metallic, non-sparking zipper is employed in the embodiment shown. Alternative separation closure devices are employed on alternative embodiments.

Figure 5:
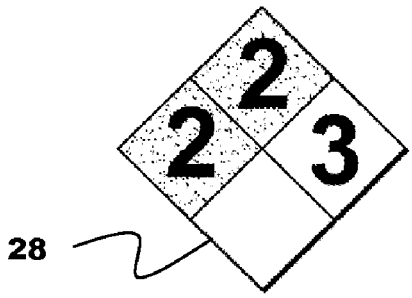
FIG. 5 is a an exemplary diamond hazard identification label pouch for use with a bag according to the present invention.
Figure 6:
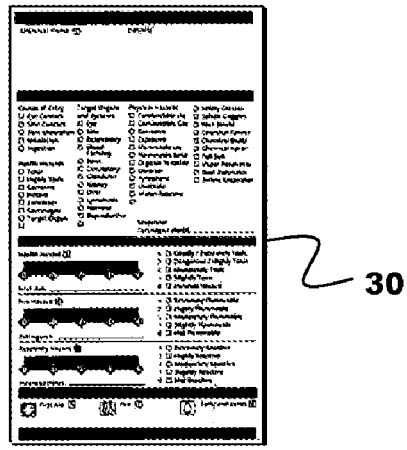
FIG. 6 is an exemplary flexible identification label pouch for use with a bag according to the present invention; and, FIG. 7 is a side view of a mating hood for transportation cap coverage.

For use with gas cylinders containing hazardous or flammable materials, the bag assembly incorporates transparent pockets 22 and 24 for diamond hazard placards 28 such as that shown in FIG. 5 or materials safety data sheets (MSDS) 30 (shown in exemplary form in FIG. 6) or other documentation regarding the cylinder and/or contents. The size and placement of the pockets is determined based on the cylinder usage and is shown in the drawings for only one exemplary embodiment. In the embodiment of the drawings, the pockets are sewn on to the main body of the bag. In alternative embodiments adhesive attachment or integral fabrication are employed.

Figure 7:
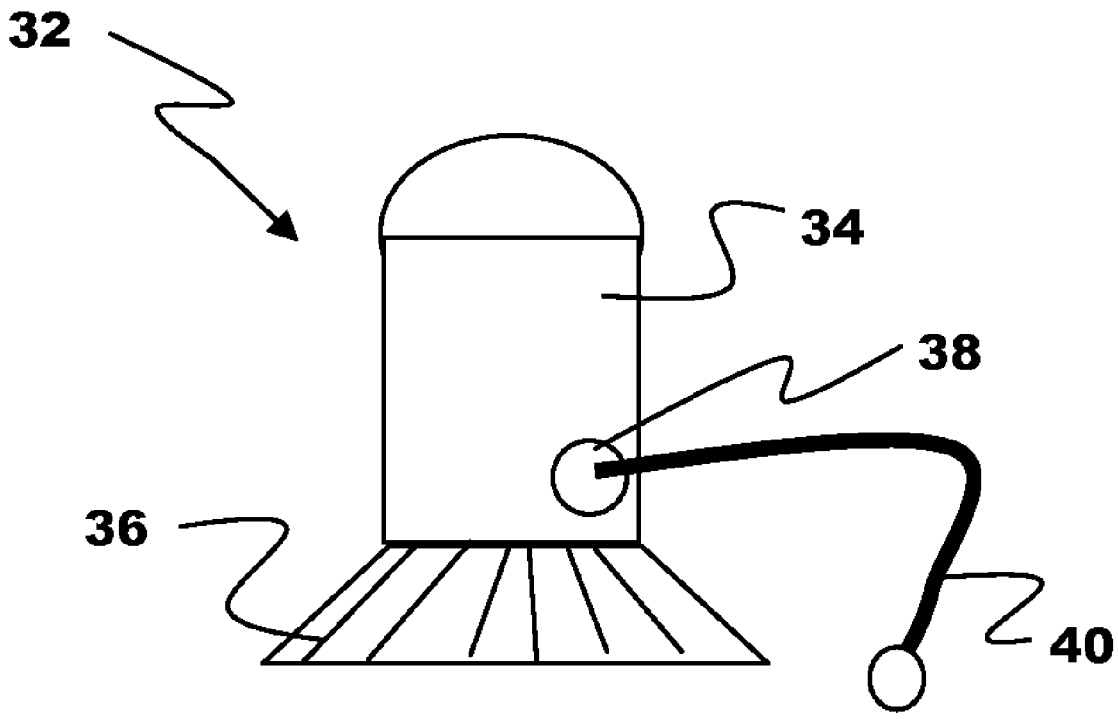

For transport or storage of cylinders, a safety cap is typically employed to prevent damage to the valve or regulator on the cylinder. To provide particulate contamination protection from the safety cap, a hood 32 is provided as shown in FIG. 7. A hood body 34 employs materials comparable to the main body of the bag assembly and terminates in a hood cuff 36 of comparable material to the cuff on the bag assembly with a taper providing a close fit over the bag cuff. Material in the hood body is impregnated with carbon fiber for ESD continuity with the bag assembly and an ESD button 38 with a grounding lead 40 is provided for attachment to a second ESD button 42 on the main body of the bag assembly.

Stitching of seams in bag body and hood components employs sewing techniques applicable to clean room garments for prevention of contaminant egress through the seams.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. An encapsulating bag for pressurized cylinders comprising:

a bag main body of fabric having a weave with a porosity of approximately less than 4.0 CFM air transmission to preclude cylinder contaminant transmission;

a bottom boot engaging a lower portion of the main body to cover a bottom of a cylinder;

separation closure means incorporated into the main body for opening the main body for insertion of the cylinder; and, a cuff attached to a top circumference of the bag main body for close engagement of a top boss of the cylinder.

2. An encapsulating bag as defined in claim 1 wherein the main body fabric is flouropolymer.

3. An encapsulating bag as defined in claim 1 wherein the main body fabric is polyester.

4. An encapsulating bag as defined in claim 1 wherein the main body fabric is impregnated with carbon fibers for conductivity to preclude ESD.

5. An encapsulating bag as defined in claim 1 wherein the bottom boot is conductive to preclude ESD.

6. An encapsulating bag as defined in claim 1 wherein the bottom boot is hypalon coated.

7. An encapsulating bag as defined in claim 1 wherein the separation closure is a non-metallic zipper.

8. An encapsulating bag as defined in claim 1 further comprising an ESD button attached to the main body.

9. An encapsulating bag as defined in claim 1 further comprising transparent pockets attached to the main body for insertion of cylinder identification information.

10. An encapsulating bag as defined in claim 1 further comprising a hood having a hood body to be received over a safety cap attached to the cylinder;

a hood cuff having a mating taper for the cuff attached to the bag main body.

11. An encapsulating bag as defined in claim 9 wherein the hood body is impregnated with carbon fiber and further comprising an ESD button and conduction lead for attachment to a second ESD button on the main body of the bag.

* * * * *